United States Patent [19]

Ritschel et al.

[11] Patent Number: 4,609,531

[45] Date of Patent: Sep. 2, 1986

[54] USE OF ALKENYLSUCCINIC ACID HALF-AMIDES AS ANTICORROSION AGENTS

[75] Inventors: Werner Ritschel, Hofheim am Taunus; Horst Lorke, Liederbach, both of Fed. Rep. of Germany

[73] Assignee: Hoechst Aktiengesellschaft, Frankfurt am Main, Fed. Rep. of Germany

[21] Appl. No.: 614,452

[22] Filed: May 25, 1984

[30] Foreign Application Priority Data

May 27, 1983 [DE] Fed. Rep. of Germany ..... 3319183

[51] Int. Cl.[4] ..... C23F 11/06; C09K 3/00

[52] U.S. Cl. ..... 422/13; 252/51.5 A; 252/392; 260/501.17; 562/553

[58] Field of Search ..... 252/51.5 A, 392; 562/553; 422/13, 16, 17; 260/501.17

[56] References Cited

U.S. PATENT DOCUMENTS

| | | | |
|---|---|---|---|
| 2,783,206 | 2/1957 | Messina | 252/51.5 A |
| 3,230,173 | 1/1966 | Spivack | 252/148 |
| 3,231,587 | 1/1966 | Rense | 562/553 X |
| 3,256,196 | 6/1966 | Eickemeyer et al. | 252/51.5 A |
| 3,269,946 | 8/1966 | Wiese | 252/51.5 A |
| 3,324,033 | 6/1967 | Knapp | 252/51.5 A |
| 3,544,467 | 12/1970 | Kautsky | 260/501.17 |
| 3,654,346 | 4/1972 | Godar et al. | 422/16 X |
| 3,903,005 | 9/1975 | Kablaoui et al. | 252/392 X |
| 3,965,027 | 6/1976 | Boffardi et al. | 260/501.17 X |
| 4,273,664 | 6/1981 | Brandolese | 252/51.5 A X |
| 4,326,987 | 4/1982 | Hendricks et al. | 422/16 X |
| 4,473,491 | 9/1984 | Trautmann et al. | 252/51.5 A X |

FOREIGN PATENT DOCUMENTS

| | | | |
|---|---|---|---|
| 1532836 | 11/1978 | United Kingdom . | |
| 2093478 | 9/1982 | United Kingdom | 252/51.5 A |

*Primary Examiner*—John F. Terapane
*Assistant Examiner*—Matthew A. Thexton
*Attorney, Agent, or Firm*—Connolly and Hutz

[57] ABSTRACT

The use, as anticorrosion agents, of alkenylsuccinic acid half-amides of the formulae $$R-\underset{\underset{COO^{\ominus}K^{\oplus}}{|}}{CH}-CH_2-CONH_2 \quad \text{and} \quad R-\underset{\underset{CONH_2}{|}}{CH}-CH_2-COO^{\ominus}K^{\oplus}$$

in which R denotes $C_6$–$C_{12}$-alkenyl and K denotes a proton or an ammonium ion of the formula $NHR_1R_2R_3$ and $R_1$, $R_2$ and $R_3$ are identical or different and denote hydrogen, $C_1$–$C_{12}$-alkyl, 2-hydroxyethyl or 2-hydroxypropyl.

2 Claims, No Drawings

USE OF ALKENYLSUCCINIC ACID HALF-AMIDES AS ANTICORROSION AGENTS

BACKGROUND OF THE INVENTION

Field of the Invention

Description of Related Art

Various succinic acid derivatives are already known as anticorrosion agents. Thus reaction products of alkenylsuccinic anhydrides with aminocarboxylic acids of the formula

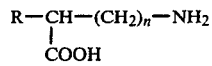

are described, for example, in U.S. Pat. No. 3,903,005.

It is already known from German Pat. No. 917,027 to add alkylsuccinic acids to hydrocarbon oils as a rust inhibitor. In media containing water, however, alkylsuccinic acids have the disadvantage of forming insoluble alkaline earth metal salts with the constituents of the water causing hardness and are thus precipitated, so that they are unsuitable for use as water-soluble anticorrosion agents.

Amine salts of amide acids which are obtained by reacting succinic or maleic anhydride with primary alkylamines containing 4–30 carbon atoms in the alkyl chain and subsequently neutralizing the product with such amines are also known from German Auslegeschrift No. 1,149,843 as lubricant or fuel additives having a rust-preventive action. However, these compounds are not oil-soluble and in most cases are not water-soluble; insofar as they are water-soluble, they develop foam much too powerfully or, if they have a low foaming action, they lose a large part of their anti-corrosion effect.

SUMMARY OF THE INVENTION

The invention relates to the use of alkenylsuccinic acid half-amides of the formulae

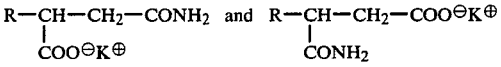

in which R denotes $C_6$–$C_{12}$-alkenyl and K denotes a proton or an ammonium ion of the formula $NHR_1R_2R_3$ and $R_1$, $R_2$ and $R_3$ are identical or different and denote hydrogen, $C_1$–$C_{12}$-alkyl, 2-hydroxyethyl or 2-hydroxypropyl.

DESCRIPTION OF THE PREFERRED EMBODIMENT

The alkenylsuccinic acid half-amides are obtained by reacting 1 mole of an alkenylsuccinic anhydride with at least 2 moles of ammonia, the alkenylsuccinic acid half-amide being obtained in the form of the ammonium salt. The reaction can be carried out with gaseous ammonia in an inert organic solvent, such as petroleum ether or toluene, in which case the ammonium salt crystallizes out; the reaction can, however, be carried out equally well with aqueous ammonia, in which case the ammonium salt is obtained in the form of an aqueous solution. The free acid can be prepared in a known manner from the ammonium salt by reacting the latter with mineral acids. The alkanolamine salts, in particular the mono-, di- or tri-ethanolamine salts, or other alkanolamine salts, such as, for instance, butylethanolamine or isopropanolamine salts, are particularly preferred for use as anticorrosion agents. These salts are obtained by reacting the ammonium salts initially obtained with an aqueous solution of the alkanolamine at elevated temperatures, ammonia being evolved in the form of gas.

Although the removal of the ammonia liberated is not necessary to achieve a good anticorrosion action, it can be advisable to free the product as completely as possible from residues of ammonia, for reasons of odor nuisance. The ammonia liberated can be removed completely by heating the aqueous solution of the alkanolammonium salt to 100° C. and passing a vigorous stream of nitrogen through the solution. The removal of the ammonia can be assisted by additionally distilling off a certain quantity of water, in the course of which it is possible at the same time to establish a specific concentration of the active substance.

The alkenylsuccinic acid half-amides described above are products which dissolve in water to form a clear solution or can be emulsified readily and which are generally present in the form of viscous liquids. These products can be employed with particular advantage as anticorrosion agents in aqueous cooling lubricants, especially drilling, cutting and milling fluids. These aqueous cooling lubricants are prepared by stirring the reaction products into the required quantity of water. It is preferable to use without further treatment the aqueous solutions such as are obtained in the preparation of these products. The concentration used in the aqueous drilling, cutting and milling fluids is generally about 0.1 to 10% by weight, preferably 2 to 5% by weight. If necessary, it is also possible to add further active compounds which are known for this end use. The aqueous anticorrosion agents are low-foaming, clear aqueous solutions to emulsion-like fluids.

EXAMPLE 1

The ammonium salt of tripropenylsuccinic acid half-amide 70 g of concentrated ammonia solution (approx. 25% strength = approx. 1.2 moles of $NH_3$) and 20 g of water are initially taken and are cooled to 0° C. 112 g (0.5 mole) of tripropenylsuccinic anhydride are then added dropwise with stirring in the course of 1 hour, the internal temperature being kept at 0°–5° C. When the dropwise addition is complete, the mixture is stirred for a further 2 hours without cooling, and approx. 200 g of a slightly yellow solution are obtained, containing approx. 65% of active substance.

EXAMPLE 2

The triethanolamine salt of tripropenylsuccinic acid half-amide 200 g (0.5 mole) of a solution of the ammonium salt of tripropenylsuccinic acid half-amide, prepared in accordance with Example 1, are heated with 50 ml of water and 150 g (1 mole) of triethanolamine at 100° C., in the course of which a vigorous stream of nitrogen is passed through the solution. At the same time, approx. 50 ml of water are distilled off via a descending condenser. A yellow solution containing approx. 80% of active substance is obtained.

EXAMPLE 3

The diethanolamine salt of tripropenylsuccinic acid half-amide 79 g (0.75 mole) of diethanolamine are added to 200 g (0.5 mole) of a solution of the ammonium salt of tripropenylsuccinic acid half-amide prepared in accordance with Example 1, and the mixture is heated at 100° C. for 1 hour, in the course of which a vigorous stream of nitrogen is passed through the solution. A yellow solution of the product with a strength of approx. 75% is obtained.

EXAMPLE 4

The ethanolamine salt of tripropenylsuccinic acid half-amide 46 g (0.75 mole) of ethanolamine are added to 200 g (0.5 mole) of a solution of the ammonium salt prepared in accordance with Example 1, and the mixture is heated at 80° C. for 2 hours, in the course of which a vigorous stream of nitrogen is passed through the solution. 235 g of a yellow solution containing approx. 70% of active substance are obtained.

EXAMPLE 5

The ammonium salt of tetrapropenylsuccinic acid half-amide 70 g of concentrated ammonia solution (approx. 25% strength = approx. 1.2 moles of $NH_3$) and 50 ml of water are initially taken and are cooled to 0° C. 133 g (0.5 mole) of tetrapropenylsuccinic anhydride are added dropwise thereto, with stirring and in the course of 1 hour, while maintaining the internal temperature at 0°–5° C. When the dropwise addition is complete, the mixture is stirred for a further 2 hours without cooling, and approx. 250 g of a brown solution containing approx. 60% of the active substance are obtained.

EXAMPLE 6

The triethanolamine salt of tetrapropenylsuccinic acid half-amide 125 g (approx. 0.25 mole) of a solution of the ammonium salt prepared in accordance with Example 5 are heated at 100° C. for 2 hours with 100 g (0.66 mole) of triethanolamine, in the course of which nitrogen is passed through the solution. Approx. 220 g of a brown solution containing approx. 80% of active substance are obtained.

EXAMPLE 7

The ammonium salt of octenylsuccinic acid half-amide 105 g (0.5 mole) of octenylsuccinic anhydride (prepared from 1-octene and maleic anhydride) are added dropwise, in the course of 1 hour, to a solution, cooled to 0° C., of 70 g of aqueous ammonia (approx. 25% = approx. 1.2 moles), the internal temperature being kept at 0°–5° C. The mixture is stirred for a further 2 hours without cooling, and approx. 170 g of a slightly yellow solution containing about 75% of the ammonium salt of octenylsuccinic acid half-amide are obtained.

EXAMPLE 8

The triethanolamine salt of octenylsuccinic acid half-amide 85 g (0.25 mole) of a solution of the ammonium salt of octenylsuccinic acid half-amide, prepared in accordance with Example 7, are heated at 100° C. for 2 hours with 70 g (0.47 mole) of triethanolamine, $NH_3$ being evolved. Approx. 150 g of a yellow solution containing approx. 85% of active substance are obtained.

EXAMPLE 9

The butylethanolamine salt of octenylsuccinic acid half-amide 85 g (0.25 mole) of a solution of the ammonium salt of octenylsuccinic acid half-amide, prepared in accordance with Example 7, are heated at 100° C. for 2 hours with 70 g (0.6 mole) of n-butylethanolamine, $NH_3$ being evolved. Approx. 150 g of a yellow solution containing about 85% of the active substance are obtained.

EXAMPLE 10

The isopropanolamine salt of octenylsuccinic acid half-amide 85 g (0.25 mole) of a solution of the ammonium salt of octenylsuccinic acid half-amide, prepared in accordance with Example 7, are heated at 100° C. for 2 hours with 50 g (0.66 mole) of isopropanolamine (1-amino-2-propanol), $N_2$ being passed through the solution meanwhile. Approx. 125 g of a yellow solution containing approx. 90% of active substance are obtained.

COMPARISON SUBSTANCE A 25 g (0.1 mole) of tripropenylsuccinic acid (prepared by hydrolysis of tripropenylsuccinic anhydride) are stirred at 80° C. with 50 g (0.33 mole) of triethanolamine and 20 g of $H_2O$ until a clear solution is formed. 95 g of a pale yellow solution containing approx. 80% of active substance are obtained.

COMPARISON SUBSTANCE B 25 g (0.1 mole) of tripropenylsuccinic acid are stirred at 80° C. with 30 g (0.28 mole) of diethanolamine and 20 g of $H_2O$ until a clear solution has been formed. 75 g containing approx. 73% of active substance are obtained.

COMPARISON SUBSTANCE C 25 g (0.1 mole) of tripropenylsuccinic acid are stirred at 80° C. with 15 g of (0.25 mole) of ethanolamine and 10 g of $H_2O$ until a clear solution is formed. 50 g of a clear, 80% strength solution are obtained.

The properties of the products from Examples 1 to 10 and of the comparison substances A–C are listed in the following table.

| | Example | | | | | | | | | | | | |
|---|---|---|---|---|---|---|---|---|---|---|---|---|---|
| | 1 | 2 | 3 | 4 | 5 | 6 | 7 | 8 | 9 | 10 | A | B | C |
| Appearance/20° C. | ← | ← | ← | brown, clear liquid | | | | → | → | → | brown, cloudy and viscous | | |
| pH of a 1% solution in distilled $H_2O$ | 8.7 | 8.2 | 8.6 | 8.6 | 8.6 | 8.5 | 8.6 | 8.7 | 8.9 | 8.8 | 8.6 | 8.9 | 8.9 |
| A 3% strength solution in $H_2O$ | | | | | | | | | | | | | |

-continued

| | Example | | | | | | | | | | | | |
|---|---|---|---|---|---|---|---|---|---|---|---|---|---|
| | 1 | 2 | 3 | 4 | 5 | 6 | 7 | 8 | 9 | 10 | A | B | C |
| 0° German hardness, at once | ← | ← | ← | | clear - opalescent | | | → | → | → | ← | cloudy | → |
| 0° German hardness, 24 hours | ← | ← | ← | | clear - opalescent | | | → | → | → | ← | cloudy | → |
| 20° German hardness, at once | ← | ← | ← | | opalescent | | | → | → | → | ← | flocculates | → |
| 20° German hardness, 24 hours | ← | ← | | | strongly opalescent - slightly cloudy | | | → | → | → | ← | flocculates | → |
| Foam behavior: Ross-Miles | | | | | | | | | | | | | |
| Start | ← | ← | ← | | foam | | | → | → | → | | considerable foam | |
| After 5 minutes | ← | ← | ← | | foam has collapsed | | | → | → | → | ← | foam unchanged | → |
| Corrosion prevention | | | | | | | | | | | | | |
| DIN 51,360/1 1% strength solution | ← | ← | ← | | no rust | | | → | → | → | ← | white specks | → |
| DIN 51,360/2 3% strength solution | 2 | 0 | 0 | 0 | 2 | 0 | 2 | 0 | 1 | 0 | 3 | 2 | 2 |

We claim:

1. A method for inhibiting corrosion caused by an aqueous medium comprising the step of adding to the aqueous medium as an anticorrosion agent an alkenylsuccinic acid half-amide of the formulae

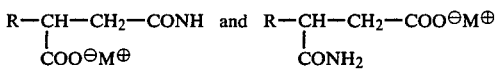

in which R denotes $C_6$–$C_{12}$-alkenyl and M denotes a proton or an ammonium ion of the formula $NHR_1R_2R_3$ and $R_1$, $R_2$ and $R_3$ are identical or different and denote hydrogen, $C_1$–$C_{12}$-alkyl, 2-hydroxyethyl or 2-hydroxypropyl, said half-amide obtained by reacting 1 mole of an alkenylsuccinic anhydride of the formula

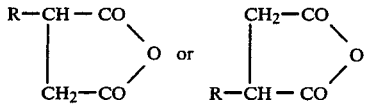

with at least two moles of ammonia at a temperature of from 0° to 5° C. and converting the ammonium salt thus obtained into different salts under the meaning of $M^{\oplus}$ if $M^{\oplus}$ does not represent an ammonium ion, and at a pH of a 1 percent solution in distilled water.

2. A method of inhibiting corrosion which comprises the step of employing in an aqueous medium a solution comprising an alkenylsuccinic acid half-amide of the formulae

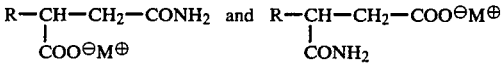

in which R denotes $C_6$–$C_{12}$-alkenyl and M denotes a proton or an ammonium ion of the formula $NHR_1R_2R_3$ and $R_1$, $R_2$ and $R_3$ are identical or different and denote hydrogen, $C_1$–$C_{12}$-alkyl, 2-hydroxyethyl or 2-hydroxypropyl, said half-amide obtained by reacting 1 mole of alkenylsuccinic anhydride of the formula

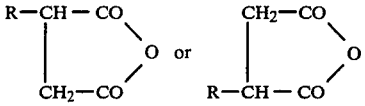

with at least two moles of ammonia at a temperature of from 0° to 5° C. and converting the ammonium salt thus obtained into different salts under the meaning of $M^{\oplus}$ if $M^{\oplus}$ does not represent an ammonium ion, and at a pH of a 1 percent solution in distilled water.

* * * * *